US005532902A

United States Patent [19]

Beyer et al.

[11] Patent Number: 5,532,902

[45] Date of Patent: Jul. 2, 1996

[54] AIR IONIZING DEVICE

[75] Inventors: Douglas H. Beyer, Cathedral City; Eugene V. Williams, Desert Hot Springs; Jose A. Alvarez, Palm Springs, all of Calif.

[73] Assignee: Richmond Technology, Inc., Redlands, Calif.

[21] Appl. No.: 386,110

[22] Filed: Feb. 8, 1995

[51] Int. Cl.[6] ..... H05F 3/06

[52] U.S. Cl. ..... 361/230; 361/213; 361/229

[58] Field of Search ..... 361/213, 225, 361/229, 230, 231; 250/423 R, 324–326

[56] References Cited

U.S. PATENT DOCUMENTS

| | | | |
|---|---|---|---|
| 3,619,719 | 11/1971 | Waller et al. | 361/230 |
| 4,037,268 | 7/1977 | Gallagher | 361/231 |
| 4,048,667 | 9/1977 | Brennecke | 361/213 |
| 4,349,511 | 9/1982 | Owen | 361/231 X |
| 4,496,375 | 1/1985 | Le Vantine | 55/131 |
| 4,689,715 | 8/1987 | Halleck | 361/213 |
| 4,750,080 | 6/1988 | Cumming et al. | 361/213 |
| 4,768,126 | 8/1988 | Le Vantine | 361/213 |
| 4,974,115 | 11/1990 | Breidegam et al. | 361/231 |
| 5,150,273 | 9/1992 | Le Vantine | 361/221 |

*Primary Examiner*—Fritz M. Fleming
*Attorney, Agent, or Firm*—Stetina Brunda & Buyan

[57] ABSTRACT

An air ionizing device that minimizes interference with existing room-air flow and lighting, comprising a narrow enclosed housing of an insulating material having intake openings and vent openings. Disposed inside the housing is a fan that takes room-air axially through the openings in the housing, and disperses the air radially. The room-air collects inside the housing until the capacity is reached, and then flows downwardly in a laminar fashion sufficiently near a plurality of electrodes to be ionized. The ionized air exits through vents in the housing and is directed towards the workbench. The housing may be extruded to many different lengths, and include a plurality of fans. Sections of the housing may be attached together to span across a long workstation. A conductive rail runs the length of the housing to electrically connect the electrodes. The outside of the housing is formed of smooth concave-shaped surfaces to avoid interfering with existing room-air flow.

6 Claims, 2 Drawing Sheets

10
12
14
16
18
20
22
24
26
28
30
32
34
35
36
37
38
4
4
2"
4"

AIR IONIZING DEVICE

FIELD OF THE INVENTION

The present invention relates generally to air ionizing devices which produce a flow of ionized air to neutralize static charges, and more particularly to air ionizing devices which minimize interference with existing room-air flows and lighting.

BACKGROUND OF THE INVENTION

The problems associated with statically charged air particles in the vicinity of sensitive manufacturing processes and sensitive workpieces are not new. The build up of static charges on sensitive electronic components may lead to severe damage of those components. The localized static charges themselves may damage or degrade particularly sensitive electronics. More importantly, electrotatic forces on electronics surfaces create an electric field that attracts contaminants carried by the air. Dust particles in the air may be so small that they are little affected by gravity, but rather settleing of the dust particles is brought about by electrostatic forces.

Air ionizing apparatus are well known to dramatically reduce the deposition rate of small dust particles, by propelling ions into the air surrounding a work area to neutralize charged materials present. Partridge U.S. Pat. No. 5,055,963 (issued Oct. 8, 1991) describes a housing with generally open inlet and outlet passages, and a fan and electrodes mounted inside the housing. The fan creates an air flow that pulls room-air through an opening in the back of the housing, and after being ionized the air is propelled out an opening in the front of the housing. Le Vantine U.S. Pat. No. 4,635,161 (issued Jan. 6, 1987) discloses a device having dual air supplies that lead to a positive or negative electrode, and the ionized air is mixed in a vortex chamber. The ionized air is then propelled out the front of the device through small air jets.

Other prior art devices include air ionizing rings where high pressure air is supplied through a small gap in the ring, and flows through the ring past electrodes into the workstation, the air ionizing rings are typically precision machined parts to provide the small gap and surfaces around which the air flows. Shims may be required to control the dimensions of the small gap.

Although such devices as described above have proven generally suitable for their intended purposes, they possess inherent deficiencies which detract from their overall effectiveness in the marketplace. Clean-room environments where electronics manufacturing takes place, have air and lighting coming from overhead. The air is typically delivered throught high efficiency (HEPA) filters that remove contaminants carried in the source air. The devices of the prior art tend to disrupt the air flow from overhead, as well as interfering with the overhead lighting by casting a shadow across the workstation. Devices of the prior art made of metal or having exposed electrodes may be safety hazards, due to electric shock or contact with sharp ends of electrodes. Also, the designs of the prior art do not lend themselves to providing a flow of ionized air across a wide workbench. The devices are not designed to be connected in a modular fashion, to span across an entire workstation. And, the designs of the prior art are not aesthetically appealing and are noisy in operation.

SUMMARY OF THE INVENTION

In view of the shortcomings of the prior art, it is the object of the present invention to provide an air ionizing device which minimizes interference with the ventilation and lighting from overhead in a clean-room environment. It is the object of the present invention to provide a device largely enclosed in an insulating material that is safe to operate. It is a further object of the present invention to provide an air ionizing device that spans across a workstation. And, it is an object of the present invention to provide an aesthetically appealing design that operates quietly.

The present invention specifically addresses the above-mentioned objectives, and alleviates the above-mentioned deficiencies associated with the prior art. More particularly, the present invention includes a narrow profile housing suspended overhead near a workstation, the housing containing a fan that pulls room-air through front intake openings. The fan changes the direction of the air, and the air collects in the housing to create a continuous and steady downward air flow past electrodes, and through vent holes and towards the workstation.

The preferred embodiment includes plural fans and corresponding openings laterally spaced apart along the length of an elongate housing. The preferred embodiment further includes a pair of channels mounted inside the housing running the length of the housing, and disposed inside each channel is a rail that is connected a high-voltage power supply. Apertures in the channels provide easy connections for a plurality of electrodes to each rail. The top side and the vent side of the outside of the housing are preferably formed having smooth concave-shaped surfaces, enabling undisturbed room-air flow around the housing.

The air ionizing device of the present invention pulls a flow of room-air through an opening in the enclosed housing of insulting material. The device disperses the air radially within the housing, and the air is collected within the housing. A laminar flow of air moves past the electrodes, ionization occurs, and the ionized air flows out into the workstation. The design of the present invention is such that the narrow profile of the housing and the laminar air flow produced cause very minimal interference with the ventilation and lighting of the clean-room. The device of the present invention is attractive looking, and offers a 30% reduction in the operating noise level compared to conventional open-fan designs.

These as well as other advantages of the present invention will become more apparent from the following description and drawings. It is understood that changes in the specific structure shown and described may be made within the scope of the claims without departing from the spirit of the invention.

DETAILED DESCRIPTION OF THE PREFERRED EMBODIMENT

Figures 1, 2, 3:
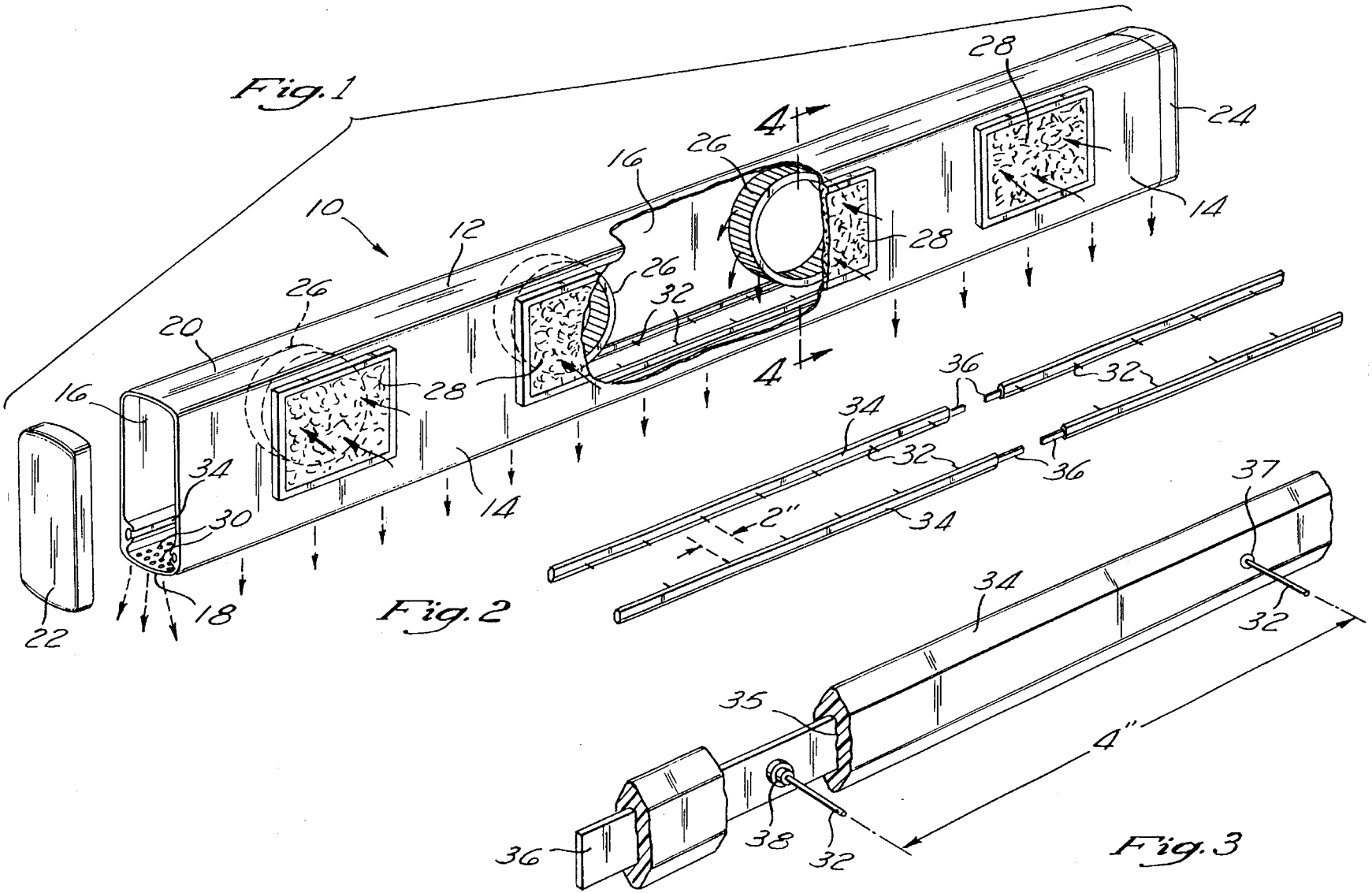
FIG. 1 is a perspective view showing the components of the present invention, and the air flows generated by the device.
FIG. 2 is a perspective view of the channels, rails and electrodes of the present invention, shown removed from the housing.
FIG. 3 is a detailed view with a portion of the channel removed to show the assembly of the electrodes to the rail.

The detailed discussion set forth below in connection with the appended drawings is intended as a description of the presently preferred embodiments of the invention, and is not intended to represent the only forms in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

Referring generally to FIGS. 1–4, the structure of the air ionizing device 10 includes an enclosed housing 12, preferably fabricated of an extruded plastic material. The housing 12 has six (6) sides, namely an intake side 14, an opposing back side 16, a vent side 18 and opposing top side 20, and a pair of opposing ends 22 and 24. The height of the housing 12 of the preferred embodiment is approximately eight (8) inches, and the width is typically about two (2) inches. The length of the housing as shown is approximately four (4) feet, though obviously many different lengths could be fabricated. Alternatively, sections of housings could be attached together to span across a long work area. Disposed inside the housing 12 are a number of conventional fans 26. The intake side 14 of the housing 12 has a number of openings 28 that correspond to each of the fans 26. The size of the openings 28 are approximately the same size as the outside envelope of the rotating blades of the fan 26. An opening 28 with a square shape is shown here, though obviously other shapes would be equally functional. The fans 26 are operative to pull room-air axially through the intake openings 28, and change the direction of the air to disperse radially. The flow of air through the air ionizing device 10 will be described in further detail later in this discussion. The vent side 18 of the housing 12 has a multiplicity of apertures 30 or a grating which allows air to exit the housing 12. The fans 26 and the openings 28 are preferably spaced apart from one another on approximately twelve (12) inch center to center spacing, to span across the work station. Obviously, the spacing may be varied depending upon the desired effect. The recommended location of the air ionizing device 10 is approximately thirty (30) inches above the work bench.

Referring to FIGS. 2 and 3, the assembly and electrical connections of the air ionizing device 10 will be discussed. A multiplicity of electrodes 32 are mounted to a pair of channels 34, preferably made of a moldable polymer material. The channels 34 have an interior cavity 35, and disposed within the cavity 35 is a rail 36, preferably made of brass or other electrically conductive material. The rail 36 is electrically connected to a conventional high voltage power supply (not shown), which is preferably positioned within the housing 12. The channels 34 are adhesively bonded to the intake side 14 and the back side 16 of the housing 12. Conveniently, one of the rails 36 is hooked up to the positive terminal of a conventional high-voltage power supply (not shown), and the other rail 36 is hooked up to the opposite polarity terminal. A multiplicity of small metallic inserts 38 are installed in apertures 37 of the channels 34, making electrical contact with the rail 36. The electrodes 32 are installed into the inserts 38. The electrodes 32 on each channel 34 are typically mounted apart from each other on four (4) inch center to center spacing, though obviously that spacing may be varied. The electrodes 32 on the two channels 34 are preferably not directly across from each other but offset approximately two (2) inches to provide a balanced flow of positively and negatively charged particles.

Figure 4:
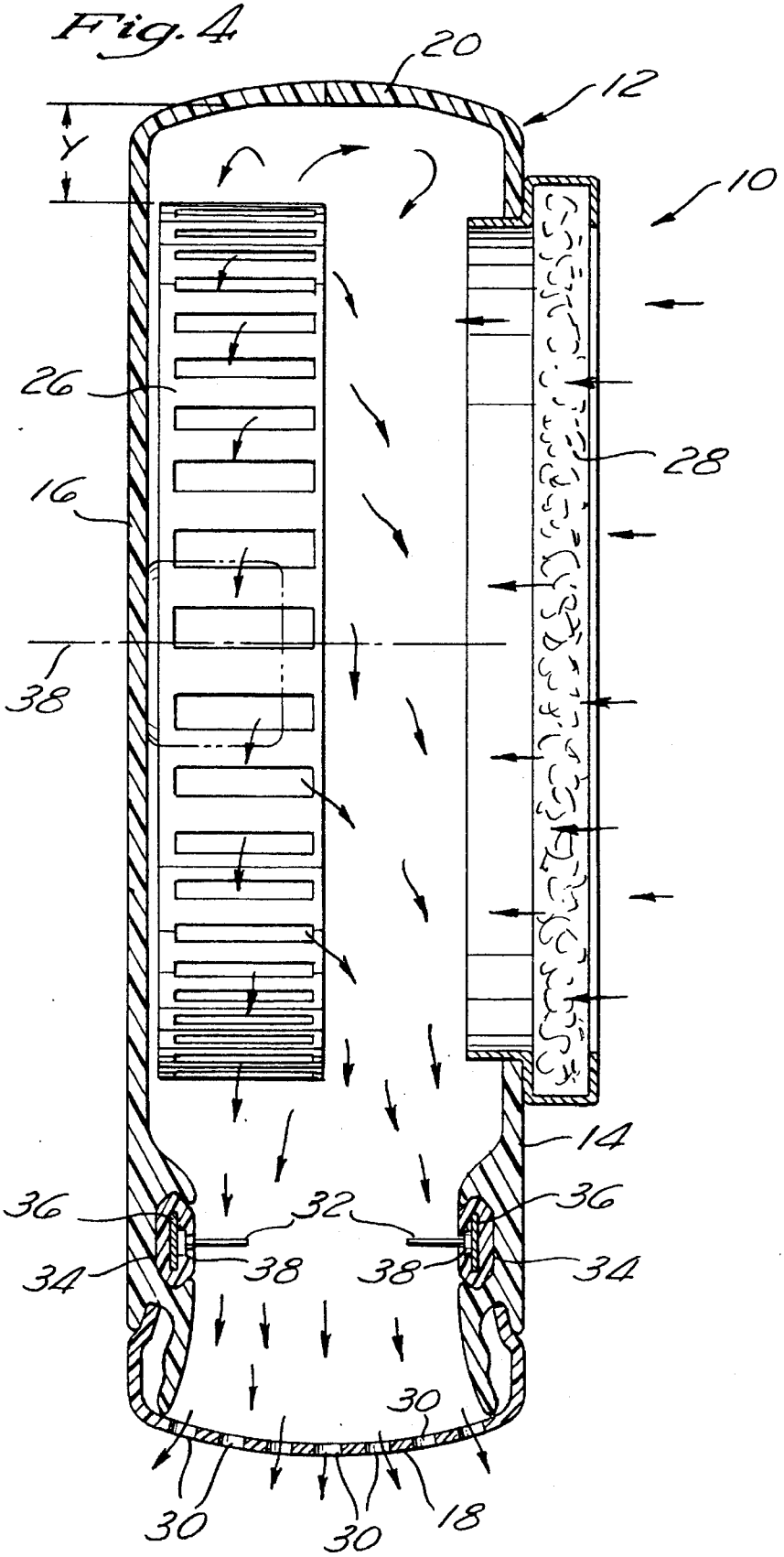
FIG. 4 is a detailed side view showing the air flows generated by the device.

Evident from FIG. 4, the vent side 18 is removable from the housing 12, to provide access for maintenance of the electrodes 32. The vent side 18 may be simply snapped back into place, between the intake side 14 and the back side 16 of the housing 12. Moist room-air that is ionized leaves deposits of aluminum nitrate on the electrodes 32, that tend to accumulate over time and adversely affect performance of the electrodes 32. Optionally, a number of conventional conductive sensors (not shown) may be added to detect when one or more electrodes are not operating properly.

Referring to FIG. 4, the present invention operates as follows. Room-air is pulled in through the openings 28 in the intake side 14 of the housing 12 with the plural fans 26. The fans 26 are operative to intake the air axially and output the air radially outward within the interior of the housing 12. Importantly, sufficient space exists around the rotating blades of the fan 26 to allow collecting air within the interior of housing 12. For example, the clearance Y between the top side 20 of the housing 12 and the envelope defined by the rotating blades of the fan 26 is substantially greater than required to prevent the fan 26 blades from contacting the housing 12 top side 20. The incoming room-air and the radially dispersed air is initially turbulent. But, the air accumulates inside the housing 12 until the capacity of the enclosed space is reached. Then the air flows downwardly in a laminar fashion towards the vent Side 18, passing sufficiently near the electrodes 32 for ionization. The ionized air as released towards the workstation, should parallel the direction of the existing room-air flow from overhead and be at about 90% of the velocity.

It is understood that the exemplary air ionizing device described herein and shown in the drawings represents only a presently preferred embodiment of the invention. Indeed, various modifications and additions may be made to the embodiment without departing from the spirit and scope of the invention. These modifications and additions may be obvious to those skilled in the art may be implemented to adapt the present invention for use in a variety of different applications.

What is claimed is:

1. An air ionizing device for providing a flow of ionized air, the device including:

an enclosing housing of insulating material having an intake side and a vent side, the intake side having an opening to allow room-air to enter the housing, the vent side adjoining and approximately perpendicular to the intake side, and the vent side having a plurality of apertures to allow ionized air to exit the housing;

a fan mounted inside the housing and having a plurality of blades that rotate about an axis approximately perpendicular to the intake side, the fan operative to pull room-air axially through the inlet opening and disperse the room-air radially within the enclosed housing away from the axis of rotation of the blades; and a plurality of electrodes mounted inside the housing adjacent to the vent side and electrically connectable to a high voltage power source, the electrodes protruding inside the housing such that the flow of air within the enclosed housing travels sufficiently near the electrodes that ionized air is created, and the ionized air exits the housing through the vent side;

further including an elongate channel of insulating material having material removed to form a cavity running lengthwise through the channel;

a rail of conductive material disposed inside the channel cavity, and electrically connectable to the high-voltage power supply; and the channel having a plurality of apertures spaced apart along the length of the channel, the apertures sized to allow attachment of the electrodes and electrical connection of the electrodes to the rail, the channel disposed inside the housing adjacent to the vent side.

2. The air ionizing device of claim 1 wherein the device has a pair of channels disposed inside opposing sides of the housing, and a pair of rails electrically connectable to terminals of opposing polarity of the high-voltage power supply.

3. The air ionizing device of claim 1 wherein sufficient space is provided between an envelope defined by the rotating fan blades and a top side of the housing opposite the vent side, for collecting the radial flow of air, to provide a laminar flow of air past the electrodes and exiting the housing.

4. An air ionizing device for providing a flow of ionized air, the device including:

an enclosing housing of insulating material having an intake side and a vent side, the intake side having an opening to allow room-air to enter the housing, the vent side adjoining and approximately perpendicular to the intake side, and the vent side having a plurality of apertures to allow ionized air to exit the housing;

a fan mounted inside the housing and having a plurality of blades that rotate about an axis approximately perpendicular to the intake side, the fan operative to pull room-air axially through the inlet opening and disperse the room-air radially within the enclosed housing away from the axis of rotation of the blades;

a plurality of electrodes mounted inside the housing adjacent to the vent side and electrically connectable to a high voltage power source, the electrodes protruding inside the housing such that the flow of air within the enclosed housing travels sufficiently near the electrodes that ionized air is created, and the ionized air exits the housing through the vent side; and wherein the device has a plurality of fans and corresponding openings in the intake side, the fans and openings spaced apart along the length of the housing.

5. The air ionizing device of claim 4 wherein sufficient space is provided between an envelope defined by the rotating fan blades and a top side of the housing opposite the vent side, for collecting the radial flow of air, to provide a laminar flow of air past the electrodes and exiting the housing.

6. An air ionizing device for providing a flow of ionized air, the device including:

an enclosing housing of insulating material having an intake side and a vent side, the intake side having an opening to allow room-air to enter the housing, the vent side adjoining and approximately perpendicular to the intake side, and the vent side having a plurality of apertures to allow ionized air to exit the housing;

a fan mounted inside the housing and having a plurality of blades that rotate about an axis approximately perpendicular to the intake side, the fan operative to pull room-air axially through the inlet opening and disperse the room-air radially within the enclosed housing away from the axis of rotation of the blades;

a plurality of electrodes mounted inside the housing adjacent to the vent side and electrically connectable to a high voltage power source, the electrodes protruding inside the housing such that the flow of air within the enclosed housing travels sufficiently near the electrodes that ionized air is created, and the ionized air exits the housing through the vent side; and wherein the outside surfaces of the vent side and an opposing top side of the housing are smooth concave-shaped surfaces, enabling room-air to flow around the device with minimal turbulence.

* * * * *